United States Patent [19]

Miller

[11] Patent Number: 4,752,153

[45] Date of Patent: Jun. 21, 1988

[54] COMPENSATING HIGHWAY JOINT

[75] Inventor: Raphael W. Miller, Jackson, Mich.

[73] Assignee: Miller Industrial Products, Jackson, Mich.

[21] Appl. No.: 864,265

[22] Filed: May 19, 1986

[51] Int. Cl.[4] ..... E01C 11/12

[52] U.S. Cl. ..... 404/59; 52/396; 52/573; 404/49

[58] Field of Search ..... 404/47, 49, 56, 59, 404/61, 62; 411/389, 10, 11, 907, 903; 52/573, 396

[56] References Cited

U.S. PATENT DOCUMENTS

| | | | |
|---|---|---|---|
| Re. 24,921 | 1/1961 | Wilbur . | |
| 197,721 | 12/1877 | Cornell | 411/389 |
| 1,279,431 | 9/1918 | Poulston . | |
| 1,571,700 | 2/1926 | Burrell . | |
| 1,987,392 | 1/1935 | Dill . | |
| 2,106,095 | 1/1938 | Heltzel . | |
| 2,127,973 | 8/1938 | Isett . | |
| 2,262,677 | 11/1941 | Heltzel . | |
| 2,280,455 | 4/1942 | Seuberling . | |
| 2,316,233 | 4/1943 | Fischer | 404/61 |
| 2,358,328 | 9/1944 | Heltzel | 404/59 |
| 2,423,695 | 7/1947 | Falco | 52/573 |
| 2,482,836 | 9/1949 | Brickman et al. | 404/47 |
| 2,512,029 | 6/1950 | Mankki | 52/573 |
| 2,858,748 | 11/1958 | Crone | 404/59 |
| 3,045,565 | 7/1962 | Nettleton | 404/59 |
| 3,066,581 | 12/1962 | Goldbeck | 52/573 |
| 3,329,072 | 7/1967 | Rice | 404/59 |
| 3,408,887 | 11/1968 | Villo | 411/339 |
| 3,572,225 | 3/1971 | Burton | 404/47 |
| 3,972,640 | 8/1976 | Miller . | |
| 3,992,974 | 11/1976 | Miki et al. | 411/544 |
| 4,072,081 | 2/1978 | Curtis et al. | 411/10 |

FOREIGN PATENT DOCUMENTS

| | | | |
|---|---|---|---|
| 9757 | 1/1977 | Japan | 411/10 |
| 1213734 | 11/1970 | United Kingdom | 411/10 |

*Primary Examiner*—John E. Murtagh
*Assistant Examiner*—Caroline D. Dennison
*Attorney, Agent, or Firm*—Beaman & Beaman

[57] ABSTRACT

The invention pertains to a compensating highway joint system for interconnecting adjacent concrete highway sections having obliquely disposed end joints. The highway joint utilizes a V-shaped vertical separator plate which forms a tongue and groove relationship between adjacent highway sections and the separator plate supports a plurality of elongated slab bolts having opposite end regions embedded within the adjacent sections. A portion of the central region of the slab bolts is provided with a jacket of elastomeric material to provide a clearance from the surrounding concrete permitting the bolts to bend, and the ends of the bolts are provided with power cells which engage the concrete and are mounted on the bolts for limited axial displacement thereon and include spring structure to prevent excessive tension forces from being imposed on the slab bolts during extreme temperature changes.

20 Claims, 2 Drawing Sheets

III
IV
10
12
14
16
18
20
22
24
26
28
30
32
34
36
38
40
42
46
47
48
56
58
66
68

COMPENSATING HIGHWAY JOINT

BACKGROUND OF THE INVENTION

Typical concrete highway construction consists of a plurality of concrete sections located within the same plane and joined at an expansion joint perpendicularly disposed to the longitudinal length of the sections. Elastic joint material is usually placed between the section ends to permit expansion and contraction of the sections during temperature variations, and it is known to use interlocking configurations at the highway section ends to prevent misalignment problems as the sections expand and contract under temperature fluctuations. It is also known to utilize dowel bars or pins between adjacent sections to aid in alignment.

Dowel bar arrangements for highway sections are typically shown in U.S. Pat. Nos. 2,127,973 and 2,262,677. Additional patents disclosing the use of joint divider plates and dowel bar systems are shown in U.S. Pat. Nos. Re. 24,921; 1,571,700; 1,987,392 and 2,106,095.

Proposals have been made to obviate some highway section joint problems by obliquely relating the joint line to the longitudinal length of the sections. Thus, with such an arrangement expansion of the sections produces slight lateral deflection of adjacent sections without imposing excessive compressive forces on the sections as to create "buckling" and destruction of the sections due to excessive compression. Examples of such high joint sections are shown in U.S. Pat. Nos. 1,279,431 and 2,280,455.

In the applicant's U.S. Pat. No. 3,972,640, a highway joint system is disclosed for concrete sections wherein a divider plate is obliquely disposed to the length of the section and dowel bars are located within the divider plate to aid in maintaining the alignment of the sections and return the sections toward the "normal" orientation as expanded and laterally deflected sections contract. In this patent dowel bars are disclosed which produce torsion forces to aid in returning the sections to normal alignment.

While the prior art devices have proposed various solutions to the maintaining of alignment of concrete highway sections without producing excessive compression forces, buckling, the opening of joints and similar problems, a concrete highway joint system has not yet been developed which meets all of the criteria of most highway departments, while being of an economically feasible construction.

It is an object of the invention to provide a concrete highway joint which is obliquely disposed to the length of the highway sections and which utilizes slab bolts of economical construction for maintaining alignment of the sections during expansion and contraction.

Another object of the invention is to provide a concrete highway joint which is obliquely disposed to the length of the highway sections wherein a tongue and groove relationship between the adjacent sections exists to resist section misalignment and relative vertical displacement, and wherein slab bolts embedded in adjacent sections extend through the joint and impose a biasing force on the sections to return the sections to alignment during contraction without permitting the joint to open.

An additional object of the invention is to provide a concrete highway joint which is obliquely disposed to the length of the highway sections wherein a plurality of slab bolts are mounted upon a separator plate, and the end regions of the slab bolts are embedded within the concrete of adjacent sections while a portion of the slab bolts' central region is provided with clearance with respect to the surrounding concrete permitting portions of the bolt to deform under bending forces to impose a biasing action on the sections for maintaining highway section alignment during expansion and contraction thereof.

A further object of the invention is to provide separator plate structure for a concrete highway joint system wherein the separator plate is of such configuration as to produce a keying tongue and groove relationship between adjacent sections, and the separator plate is supported on a base plate which can be disassembled from the separator plate during shipping, but is readily attachable thereto to permit support of the separator plate during pouring of the highway sections.

Another object of the invention is to provide a slab bolt for use with a concrete highway section joint wherein the bolts resist tension forces to a predetermined degree, and tension forces above such predetermined value overcome spring biasing means preventing excessive forces from being imposed upon the slab bolts to prevent the bolts from permanently stretching.

In the practice of the invention a separate plate having a V-shaped configuration is supported in a vertical manner by a base plate located at the separator plate lower edge. In an embodiment of the invention the base plate may be removably affixed to the separator plate to simplify shipping, and is assembled thereto at the site of use.

The separator plate is disposed obliquely to the length of the adjacent highway sections being poured, and a plurality of slab bolts are located along the length of the separator plate at its apex. The slab bolts include a central region disposed adjacent the separator plate, and end regions which are embedded within the concrete of adjacent highway sections. The central regions of the slab bolts on one side of the separator plate are encompassed within a yieldable tubular jacket as to provide a radial and axial clearance between a portion of the central region of the bolts with respect to the surrounding concrete permitting lateral bonding deformation of the bolts without harm to the concrete. Such bending deformation of the bolts imposes a biasing force between the highway sections interconnected by the slab bolts and such force will maintain the joint at its minimum closed dimension during temperature fluctuations preventing the joint from excessively opening, and the slab bolts will maintain the proper alignment of the sections for the given temperature conditions.

Each end region of the slab bolts is provided with a unit hereinafter designated as a "power cell", which, in the disclosed embodiment includes a shoulder plate disposed transversely to the length of the slab bolts and an abutment on the bolt ends axially locates the power cell thereon. The power cells permit tension forces to be transmitted to the slab bolts, but as the power cells are axially displaceable to a limited extent on the bolts and are axially biased by stiff spring elements, excessive tension forces imposed on the power cells, and bolts, causes axial displacement of the power cells to prevent permanent stretching of the slab bolts due to metal deformation beyond the yield point.

The concrete highway joint apparatus of the invention is relatively economical to manufacture, assemble and ship, and the use of the joint with an oblique joint orientation provides superior travel movement over the joint by vehicles and prevents excessive compression forces from occurring within the highway sections, and also prevents excessive opening of the highway joints during section contraction under cold temperature conditions.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figures 1, 2, 3, 4:
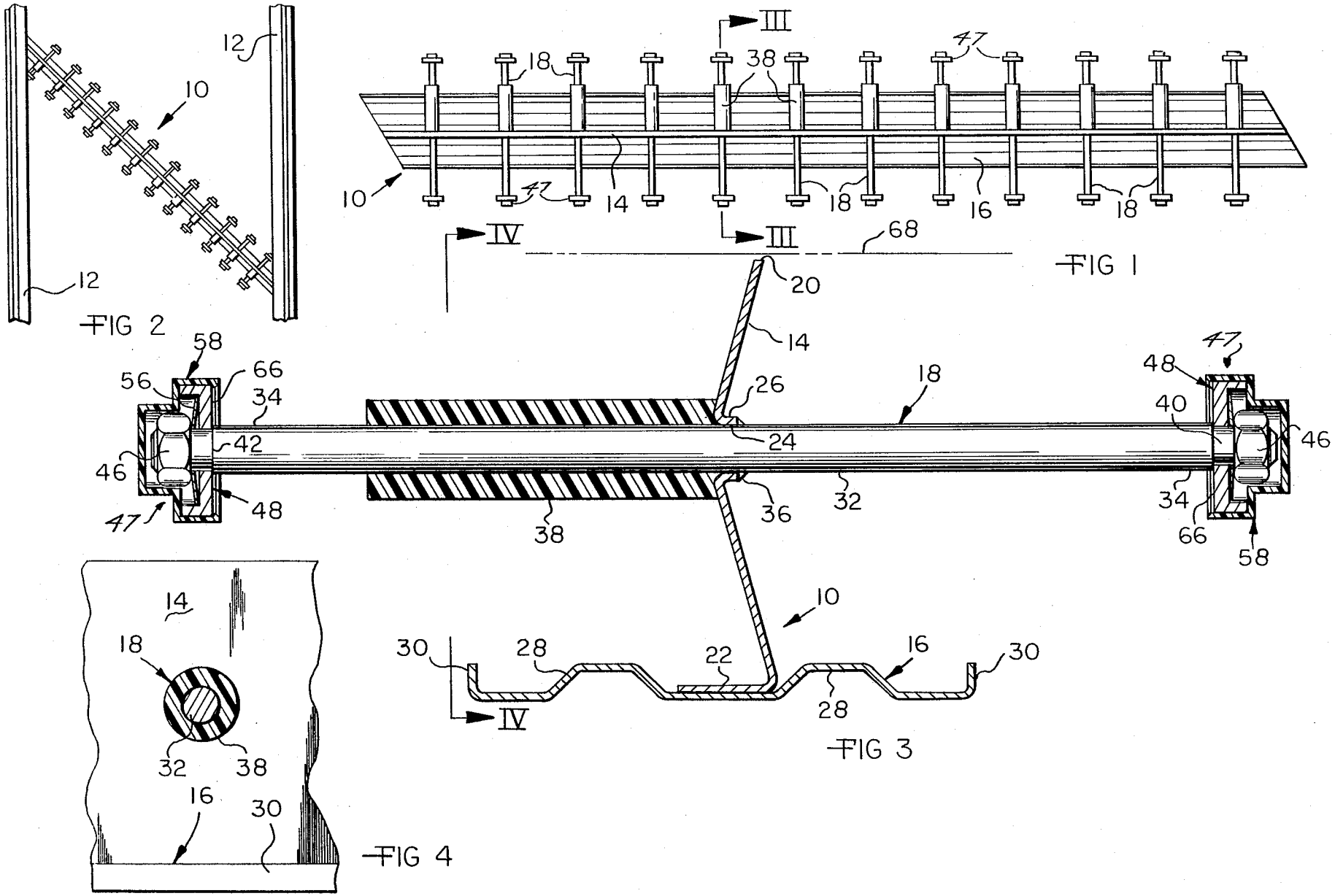
FIG. 1 is a top plan view of a highway joint constructed in accord with the inventive concepts.
FIG. 2 is a plan, detail view illustrating the installation of a joint in accord with the invention between highway section rails and prior to pouring of concrete.
FIG. 3 is an enlarged, elevational, sectional view as taken along Section III—III of FIG. 1.
FIG. 4 is an elevational, sectional view as taken along Section IV—IV of FIG. 3.

The general arrangement of a concrete highway section joint in accord with the invention is illustrated in FIGS. 1–3. The joint, generally indicated at 10, is initially located between rails 12, FIG. 2, which define the sides of concrete highway sections to be poured. The concrete pouring apparatus, not shown, rides upon the rails 12 and the concrete sections are confined between the rails. As will be appreciated from FIG. 2, the length of the joint 10 is obliquely disposed to the length of the highway sections as represented by the direction of orientation of the rails 12, and usually, the joint is disposed at 45° with respect to the highway section length.

The joint 10 includes a separator plate or key 14 supported upon a base plate 16 and a plurality of slab bolts 18 are mounted upon the separator plate equally spaced along the length thereon. The separator plate 14 is formed of sheet metal and is of an elongated configuration having an upper edge 20 and a lower edge defined by the horizontally disposed flange 22. As will be appreciated from FIG. 3, the transverse cross-section of the separator plate 14 is of a V-configuration, and at its central apex the plate is provided with a plurality of cylindrical openings 24 defined by a tubular collar 26 formed of the material displaced from the plate to form the openings.

In the embodiment shown in FIGS. 1–4, the base plate 16 is formed of sheet metal and is horizontally disposed having a plurality of reinforcing ridges 28 defined therein and upstanding edge flanges 30 which impart strength to the base plate. The separator plate flange 22 engages the upper surface of the base plate 16, and is spot welded thereto wherein the separator plate and base plate form a permanent assembly.

The slab bolts 18 are identical, and each primarily consists of a cylindrical steel rod having a central region 32 and end regions 34. The diameter of the central region 32 is substantially equal to the separator plate openings 24 and the slab bolts are closely received therein and welded to the tubular collar 24 at 36.

On the "convex" side of the separator plate 14 an annular tubular jacket 38 of a yieldable material such as synthetic plastic foam surrounds a portion of the bolt central region and has a relatively thick wall thickness, for instance, ¾", wherein the jacket will provide a clearance between the slab bolt central region 32 and the concrete in which the slab bolt is embedded which will permit bending of the slab bolt in the region of the jacket without damaging the concrete.

Figure 5:
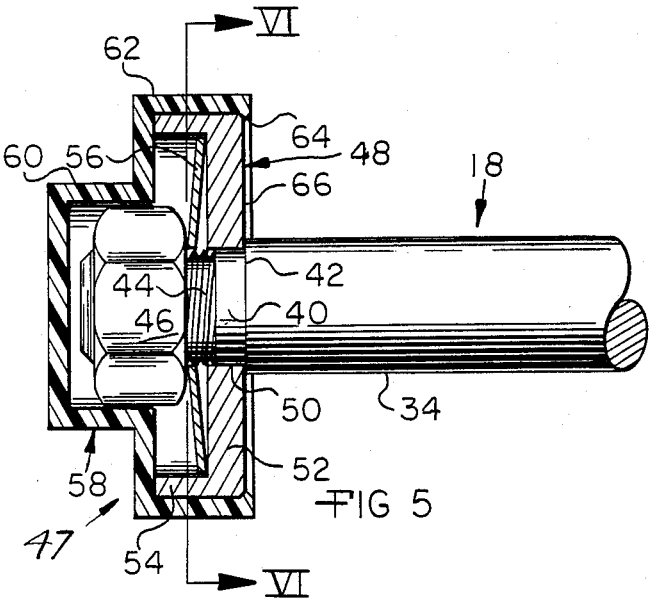
FIG. 5 is an enlarged, detail, elevational, sectional view of the end of a slab bolt in accord with the invention.
Figure 6:
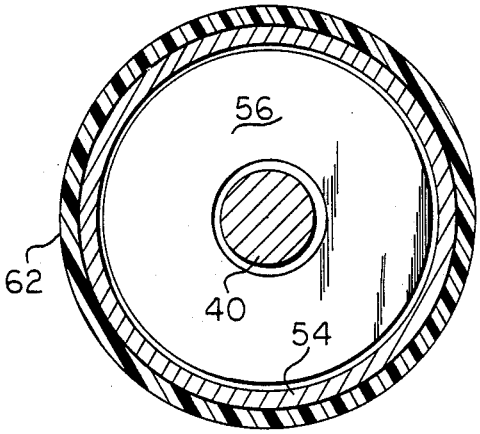
FIG. 6 is an elevational, sectional view as taken along Section VI—VI of FIG. 5.

Each end region 34 of the slab bolts is formed with a reduced diameter portion 40 which forms an annular radial shoulder 42 FIG. 5. The portions 40 are threaded at the end of the slab bolt at 44 and an abutment nut 46 is located upon this thread. A power cell 47 is mounted on each end of the slab bolts, and in the disclosed embodiment each power cell includes an annular shoulder plate 48 mounted upon the slab bolt portion 40 by a central opening 50, and the opening 50 is slightly larger than the diameter of the portion 40 wherein the shoulder plate is axially displaceable on the portion 40, and as the axial dimension between the inner edge of the nut 46 and the shoulder 42 is greater than the axial dimension of the radial portion 52 of the shoulder plate 48, limited axial displacement of the shoulder plate between the shoulder 42 and the abutment nut 46 is possible. The shoulder plate includes a cylindrical periphery defined by the outwardly extending flange 54, FIG. 5.

A high strength metal Belleville spring washer 56 is interposed between the abutment nut 46 and the shoulder plate portion 52. The conical configuration of the spring washer 56 imposes a high biasing force on the shoulder plate 48 toward the slab bolts' central region holding the shoulder plate firmly against the shoulder 42 and rotating the abutment nut will vary the biasing force exerted by the spring washer.

A dish-shaped synthetic plastic cover or cap 58 encompasses the nut 46, the spring washer 56 and the periphery of the shoulder plate 48. The cover 58 includes the portion 60 in which the nut 46 is received, and the internal cylindrical surface of the cover portion 62 tightly fits over the periphery flange of the shoulder plate and the inwardly depending lip 64 snaps over the shoulder plate inner surface 66 producing a fluid-tight seal with the shoulder plate protecting the spring washer and nut from moisture and corrosion.

As will be appreciated from FIG. 1, the complete joint assembly will include a plurality of slab bolts 18 assembled to the separator plate 14 in the aforedescribed manner. The joint 10 is placed between the rails 12 defining the lateral edges of the highway sections to be poured, and the concrete will encompass the entire joint including the slab bolts. The height of the separator plate 14 is preferably slightly less than the thickness of the highway section wherein the upper edge 20 of the separator plate will terminate slightly below the surface of the highway section as represented by line 68 in FIG. 3.

Figure 7:
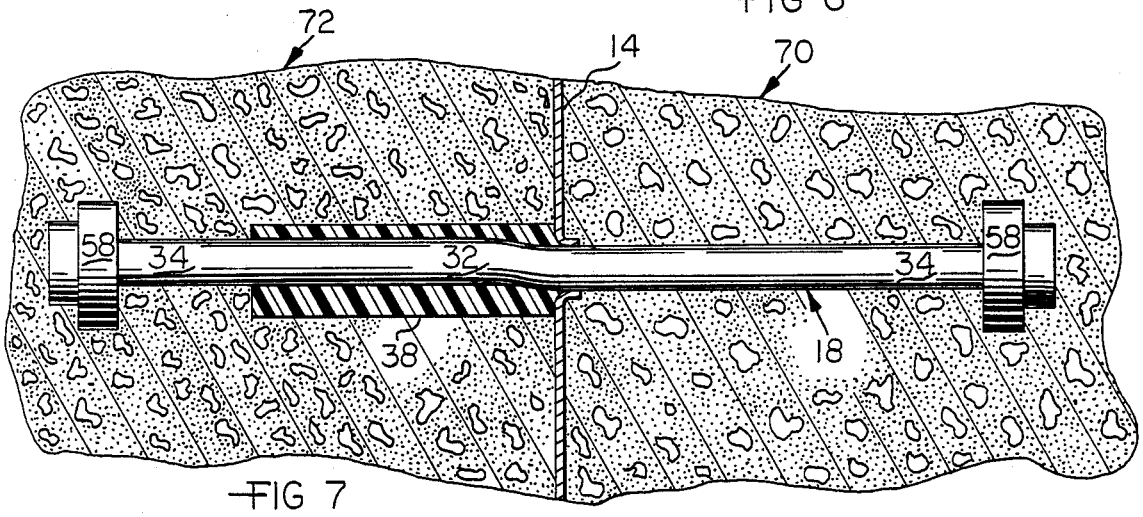
FIG. 7 is a plan, sectional view as taken through a slab bolt embedded within a highway joint illustrating deformation occurring therein due to shifting of highway sections.

Of course, the concrete of the highway sections 70 and 72, FIG. 7, will intimately engage both sides of the separator plate 14, and the V-configuration of the separator plate produces a tongue and groove relationship between the adjacent highway sections which forms a key and prevents relative vertical section displacement. Under increasing temperature conditions, the highway sections 70 and 72 will expand lengthwise, and such expansion will cause a relative lateral displacement between the highway sections due to the oblique orientation of the joint 10. Such relative lateral displacement produces a bending within the slab bolts as represented in FIG. 7. The bending shown in FIG. 7 is exaggerated for purpose of illustration. It is to be understood that the degree of lateral displacement of the highway sections is, dimensionally, quite small, and the clearance between the central region of the slab bolts and the concrete produced by the jacket 38 permits the necessary lateral bending of the bolts without damage to the concrete.

Of course, the deformation that occurs in the slab bolts 18 due to lateral shifting of the highway sections is resisted by the inherent resilient nature of the steel slab bolts, and when the temperature of the concrete sections decreases, and contraction occurs, the biasing force in a lateral direction imposed upon the highway sections by the deformed slab bolts will cause the sections to laterally displace "back" toward the normal condition insuring that the joint between the sections remains closed. The combination of the closed joint, and the oblique orientation thereof, reduces wheel noise and "tire thumping" resulting in minimal noise and vibration as produced by vehicles traveling over the joint.

The exposure of the inner surface 66 of the shoulder plates 48 to the concrete surrounding the slab bolts produces tension forces within the slab bolts as the highway sections are laterally displaced during expansion. This tension force within the slab bolts aids in producing the forces on the concrete sections 70 and 72 for biasing the sections toward each other and maintaining a closed joint during contraction. However, under extreme conditions of lateral displacement of the highway sections, the tension forces on the bolts may become excessive as to permanently stretch the slab bolts, and such occurrence is prevented by the presence of the power cells 47 and the inclusion of the spring washers 56 as the spring washers will permit axial displacement of the power cells and shoulder plates 48 toward the abutment nuts 46, and the biased axial movement of the shoulder plates protects the slab bolts from being stressed past their yield point, and the spring washer biasing force aids in the restoration of alignment of highway sections during section contraction.

Figure 8:
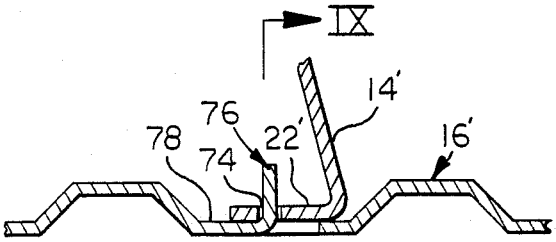
FIG. 8 is an elevational, detail, sectional view of an embodiment of interconnection between the separator plate and base plate as taken along Section VIII—VIII of FIG. 9.
Figure 9:
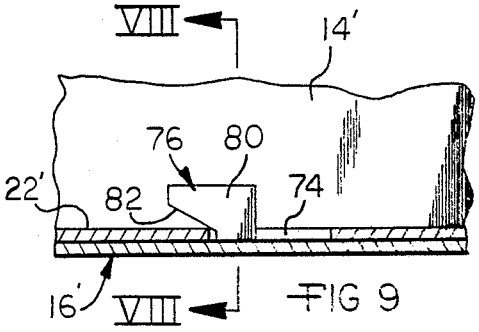
FIG. 9 is an elevational, sectional view as taken along Section IX—IX of FIG. 8.

FIGS. 8 and 9 illustrate a modified manner for interconnecting the separator plate 14' to the base plate 16'. In this embodiment the base plate flange 22' is provided with a plurality of openings 74 spaced along the length of the flange. The base plate 16' is provided with a plurality of hooks or connectors 76 lanced from the metal of the base plate and formed to extend upwardly from the base plate upper surface 78. The hooks 76 each include a head 80 which may be received through the flange openings 76 and on its underside the head 80 is formed with an obliquely related cam surface 82. Upon the hooks extending through the flange openings 74 and relative longitudinal displacement occurring between the flange and base plate 16', cam surfaces 82 will engage the edge of the flange openings 74, FIG. 9, thereby firmly affixing the base plate 16' to the separator plate 14' and permitting the base plate to support the separator plate in its vertical orientation as required during pouring of the highway.

The interconnection of FIGS. 8 and 9 permits the separator plates 14' and base plates 16' to be shipped separately which simplifies handling and reduces the cost of shipping and storage.

It is appreciated that various modifications to the inventive concepts may be apparent to those skilled in the art without departing from the spirit and scope of the invention.

I claim:

1. The method of interconnecting concrete highway slab sections having abutting ends defining a joint obliquely disposed in a horizontal direction with respect to the length of said sections with a plurality of elongated slab bolts each having end regions and a central region, said end regions each including a shoulder plate axially displaceable on the bolt and substantially perpendicularly disposed to the length of the bolts embedded in the concrete and an abutment axially fixed on the bolt and axially spaced from the shoulder plate and spring means between the shoulder plate and the abutment imposing an axial tensile force upon the bolts in that the shoulder plate is located between the abutment and the bar central region upon the shoulder plates being subjected to forces tending to separate the shoulder plates of a common bolt upon lateral displacement of adjacent highway sections, comprising the steps of embedding a plurality of substantially parallel slab bolts in adjacent sections bridging the joint wherein the central region of the bolts extends through the joint, defining a clearance between the bolts' central region and the concrete of at least one of the sections adjacent the joint sufficient for permitting lateral displacement of adjacent sections at the joint without damage to the concrete of the sections and permitting deflection of the bolts at the central regions thereof with respect to the end regions, the spring means imposing a biased tension within the bolts during lateral displacement of adjacent sections aiding to restore alignment of displaced sections.

2. A concrete highway joint system for substantially planar adjacent concrete highway slab sections having abutting ends defining a joint, the ends being obliquely disposed in a horizontal direction with respect to the length of said sections, a plurality of deflectable, resilient, elongated biasing slab bolts embedded in said sections each having end regions exposed to the concrete and a central region, the end regions of a common biasing bolt being embedded in different sections and the central region being located adjacent and bridging the joint on each side thereof, an annular resilient jacket encompassing the biasing bolts' central region defining an annular clearance between the bolts and at least one of the concrete sections adjacent the joint permitting lateral bending of the central region with respect to the bolts' length without damage to the concrete of the sections adjacent the joint, the improvement comprising, in combination, an annular power cell mounted upon each end region of the biasing bolts to prevent excessive tension forces within the bolts, said power cells each including a shoulder plate transversely disposed to the length of the associated bolt and axially displaceable thereon embedded within the surrounding concrete, an abutment axially fixed on each bolt end region adjacent each shoulder plate limiting relative shoulder plate axial movement on the bolt end region in a direction away from the associated central region, said shoulder plate being located between said abutment and the bolt central region, and compression spring means interposed between each shoulder plate and the adjacent abutment axially biasing the associated shoulder plate in a direction toward the bolt central region.

3. In a concrete highway joint system as in claim 2, a stop defined on each bolt end region axially spaced from the adjacent abutment toward the bolt's central region, said shoulder plates being located intermediate an abutment and the adjacent stop for limited axial movement therebetween.

4. In a concrete highway joint system as in claim 3, said abutments comprising a nut threaded upon each bolt end region and said stop comprising a shoulder integrally defined on the bolt end region.

5. In a concrete highway joint system as in claim 3, said compression spring means comprising an annular non-planar washer.

6. In a concrete highway joint system as in claim 3, said shoulder plate including a periphery, an inner surface disposed toward the associated bolt central region exposed to the surrounding concrete and an outer surface disposed toward the adjacent abutment, and a water impervious cover enclosing the associated abutment, compression spring means, shoulder plate outer surface and sealed to said shoulder plate periphery.

7. In a concrete highway joint system as in claim 6, said cover being formed of a synthetic plastic material having a cup-shaped configuration having an open end, said cover open end embracing said shoulder plate periphery in a snap-on relationship.

8. A slab bolt for concrete highway joints comprising, in combination, an elongated bolt of predetermined elasticity having a central region and end regions, a resilient yieldable jacket formed of an elastomer encompassing an axially extending thickness sufficient to permit transverse bending of said central region within the elastic limits of said bolt when said member is entirely embedded in concrete, a shoulder plate mounted upon each bolt end region for limited axial movement thereon and transversely disposed to the bolt length, an abutment axially fixed upon each end region adjacent a shoulder plate and on the opposite side of the adjacent shoulder plate with respect to said bolt central region, and a compression spring located between each abutment and the adjacent shoulder plate axially biasing the adjacent shoulder plate toward said central region.

9. In a slab bolt for concrete highway joints as in claim 8, a stop defined on each bolt end region axially spaced from the adjacent abutment toward the bolt's central region, said shoulder plates being located intermediate an abutment and the adjacent stop for limited axial movement therebetween.

10. In a slab bolt for concrete highway joints as in claim 9, said abutments comprising a nut threaded upon each bolt end region and said stop comprising a shoulder integrally defined on the bolt end region.

11. In a slab bolt for concrete highway joints as in claim 10, said compression spring means comprising an annular non-planar washer.

12. In a slab bolt for concrete highway joints as in claim 11, said shoulder plate including a periphery, an inner surface disposed toward the associated bolt central region and an outer surface disposed toward the adjacent abutment, and a water impervious cover enclosing the associated abutment, compression spring means, shoulder plate outer surface and sealed to said shoulder plate periphery.

13. In a slab bolt for concrete highway joints as in claim 12, said cover being formed of a synthetic plastic material having a cup-shaped configuration having an open end, said cover open end embracing said shoulder plate periphery in a snap-on relationship.

14. A separator for substantially planar concrete slab highway sections comprising, in combination, an elongated horizontally extending separator plate of V cross-sectional configuration having sides and defining an apex, a plurality of tubular openings defined in said plate spaced along the length thereof and extending through said apex, said openings comprising slab bolt support means having an axis perpendicular to the length of said plate, a bendable slab bolt supported within each of said openings having a central region located within the associated opening and end regions disposed on opposite sides of said plate, a tubular jacket of yieldable material encompassing a portion of said bolts' central region, said jacket being located upon one side of said plate and adjacent thereto, an annular shoulder plate mounted upon each end region of said slab bolts, said shoulder plates being transversely disposed to the length of the associated bolt and axially displaceable thereon, an abutment axially fixed on each bolt end region adjacent each shoulder plate limiting shoulder plate axial movement on the bolt end region in a direction away from the associated bolt central region, said shoulder plate being located between said abutment and the bolt central region, and compression spring means interposed between each shoulder plate and its adjacent abutment axially biasing the associated shoulder plate toward the associated bolt central region.

15. In a separator for concrete highway sections as in claim 14, a stop defined on each bolt end region axially spaced from the adjacent abutment toward the bolt's central region, said shoulder plates being located intermediate an abutment and the adjacent stop for limited axial movement therebetween.

16. In a separator for concrete highway sections as in claim 15, said abutments comprising a nut threaded upon each bolt end region and said stop comprising a shoulder integrally defined on the bolt end region.

17. In a separator for concrete highway sections as in claim 16, said compression spring comprising an annular non-planar washer.

18. In a separator for concrete highway sections as in claim 17, said shoulder plate including a circular periphery, an inner surface disposed toward the associated bolt central region and an outer surface disposed toward the adjacent abutment engaged by the associated compression spring, and a water impervious cover enclosing the associated abutment, compression spring and shoulder plate outer surface and sealed to said shoulder plate periphery.

19. In a separator for concrete highway sections as in claim 14, said horizontally extending separator plate having a bottom edge, a substantially horizontally extending flange defined on said separator plate bottom edge having a general plane, a plurality of openings defined in said flange spaced along the length of said flange and said separator plate, an elongated base plate located below said separator plate having an upper side, said flange engaging said base plate upper side whereby said base plate supports said separator plate, and quick-connect means defined on said base plate received within said flange openings releasably interconnecting said base plate and said separator plate.

20. In a separator for concrete highway sections as in claim 19, said quick-connect means comprising projections defined upon said base plate extending from said upper surface thereof, and a cam surface defined on each projection engaging said separator plate flange upon said projections extending through said flange openings and said separator and base plates being displaced relative to each other in the general plane of said flange.

* * * * *